US007331912B2

(12) United States Patent
Keiser et al.

(10) Patent No.: US 7,331,912 B2
(45) Date of Patent: Feb. 19, 2008

(54) ADJUSTABLE BENCH

(75) Inventors: Dennis L. Keiser, Sanger, CA (US); Wade A. Peterson, Fresno, CA (US)

(73) Assignee: Keiser Corporation, Fresno, CA (US)

( * ) Notice: Subject to any disclaimer, the term of this patent is extended or adjusted under 35 U.S.C. 154(b) by 0 days.

(21) Appl. No.: 10/880,422

(22) Filed: Jun. 28, 2004

(65) Prior Publication Data

US 2005/0032614 A1 Feb. 10, 2005

Related U.S. Application Data

(60) Provisional application No. 60/483,546, filed on Jun. 27, 2003.

(51) Int. Cl.
*A63B 26/00* (2006.01)

(52) U.S. Cl. ..... 482/142

(58) Field of Classification Search ..... 482/142; D21/676, 686, 695, 690
See application file for complete search history.

(56) References Cited

U.S. PATENT DOCUMENTS

| | | | | |
|---|---|---|---|---|
| 4,326,707 | A | 4/1982 | Strecker et al. | |
| 4,750,739 | A | 6/1988 | Lange et al. | |
| 4,936,572 | A * | 6/1990 | Desiderio | 482/142 |
| 5,350,366 | A * | 9/1994 | Schlosser et al. | 604/203 |
| 5,653,666 | A | 8/1997 | Pantoleon | |
| 5,776,037 | A * | 7/1998 | Millington | 482/91 |
| 5,823,921 | A | 10/1998 | Dawson et al. | |
| 5,951,449 | A | 9/1999 | Oppriecht et al. | |
| 6,371,896 | B1 * | 4/2002 | Kettler | 482/142 |
| 6,482,128 | B1 | 11/2002 | Michalow | |
| 6,605,023 | B1 * | 8/2003 | Mobley | 482/142 |
| 6,645,130 | B2 * | 11/2003 | Webber | 482/142 |
| 6,659,923 | B2 * | 12/2003 | Teuscher | 482/142 |
| 6,743,158 | B2 * | 6/2004 | Giannelli et al. | 482/96 |
| 6,884,203 | B2 * | 4/2005 | Forcillo | 482/142 |
| 2002/0025890 | A1 | 2/2002 | Keiser | |
| 2003/0115955 | A1 | 6/2003 | Keiser | |

* cited by examiner

*Primary Examiner*—Lori Amerson
(74) *Attorney, Agent, or Firm*—Knobbe Martens Olson & Bear LLP

(57) ABSTRACT

An adjustable bench adapted to support a human body during exercise and capable of engaging an auxiliary rack assembly is provided. The bench includes a seat and a backrest that are interconnected and moveable relative to a frame. The bench is adjustable from a generally flat configuration to one or more inclined configurations. In the flat configuration, the bench is particularly suitable for pressing exercises such as the bench press. In the fully inclined position, the bench is suitable for upright exercises such as the military press and the shoulder press. The shoulders of the human body remain generally at the same horizontal location along the bench as the backrest is inclined. The bench thus does not need to be repositioned relative to a bar as the inclination of the bench is changed.

22 Claims, 11 Drawing Sheets

ADJUSTABLE BENCH

RELATED APPLICATION

This application is based on and claims priority under 35 U.S.C. §119(e) to U.S. Provisional Patent Application No. 60/483,546, filed Jun. 27, 2003, the entire contents of which is hereby incorporated by reference.

BACKGROUND OF THE INVENTION

1. Field of the Invention

The present invention relates to exercise equipment and, more particularly, to an adjustable bench for use in conjunction with an auxiliary rack assembly for resistance training applications.

2. Description of the Related Art

One common form of exercise equipment is a bench capable of supporting a human body used in conjunction with a rack assembly. The bench typically comprises a backrest portion coupled to a seat portion. The rack assembly is used to support one or more weight bars for resistance training. Such weight bars frequently receive free weights, which may provide variable levels of resistance. Other types of resistance may also be used, including cable/pulley systems, flexible rods, pneumatic cylinders, viscous fluids, rubber structures, and the like.

When the rack assembly supports a source of resistance, such as a weight bar, changing exercises typically requires that the bench be changed from one configuration to another configuration. For example, in order to change from a flat bench press to a military press, the bench must be changed from a generally flat configuration to a suitably inclined configuration. One drawback of a typical bench is that, as the bench is inclined, the backrest portion becomes horizontally displaced relative to the weight bar. This effectively positions a user's chest and shoulders farther away from the weight bar. As a result, the user must shift the bench horizontally relative to the rack assembly in order to maintain the chest and shoulders in an optimal position below the weight bar.

What is needed, therefore, is an adjustable bench for use in conjunction with a rack assembly, wherein the inclination of the bench can be changed without the bench having to be moved horizontally relative to the rack assembly.

SUMMARY OF THE INVENTION

According to one aspect of the present invention, an adjustable bench adapted to support a human body during exercise and capable of engaging an auxiliary rack assembly is provided. The bench includes a seat and a backrest that are interconnected and moveable relative to a frame. The bench is adjustable from a generally flat configuration to several increasingly inclined configurations. In the flat configuration, the bench is particularly suitable for pressing exercises such as the bench press. In the fully inclined position, the bench is suitable for upright exercises such as the military press and the shoulder press. The shoulders of the human body remain generally at the same horizontal location, as the bench, and thus the torso of the human body, is increasingly inclined. Thus, the adjustable bench herein disclosed is particularly suitable for use in conjunction with an auxiliary rack assembly that supports a weight bar over the backrest.

In another aspect of the present invention, an exercise bench for resistance training is provided. The exercise bench comprises a frame, a seat mounted on the frame, and a backrest mounted on the frame. The backrest pivots relative to the frame about a pivot axis as it is moved to a plurality of positions between generally upright and generally prone. The backrest is also mechanically coupled to the frame such that the pivot axis moves generally horizontally along the frame as the backrest is raised or lowered.

In another aspect of the present invention, an exercise bench is provided. The exercise bench has a backrest with an adjustable angle of inclination. The backrest is mounted on a frame such that adjustment of the angle of inclination causes said backrest to rotate about a pivot axis and causes translation of the pivot axis generally horizontally as said angle is adjusted. The translation of the pivot axis causes a location of shoulder height on the backrest to move along a generally vertical axis as the angle of inclination changes.

According to another aspect of the present invention, an exercise bench is provided. The exercise bench has a backrest with an adjustable angle of inclination. The exercise bench further has a means for moving a location of shoulder height on said backrest along a generally vertical axis as the angle of inclination is changed.

Another aspect of the present invention comprises a method of adjusting an exercise bench. This method comprises: exercising with a backrest of the bench in a first position that is significantly inclined relative to a second position; and adjusting the backrest to the second position without moving the bench such that, when exercising with the backrest in the second position the shoulders of the user are in substantially the same vertical plane as when exercising with the backrest in the first position.

BRIEF DESCRIPTION OF THE DRAWINGS

The above mentioned and other features will now be described with reference to the drawings of the present exercise bench. The shown embodiments are intended to illustrate, but not to limit the invention. The drawings contain the following figures.

DETAILED DESCRIPTION OF A PREFERRED EMBODIMENT

Figure 1:
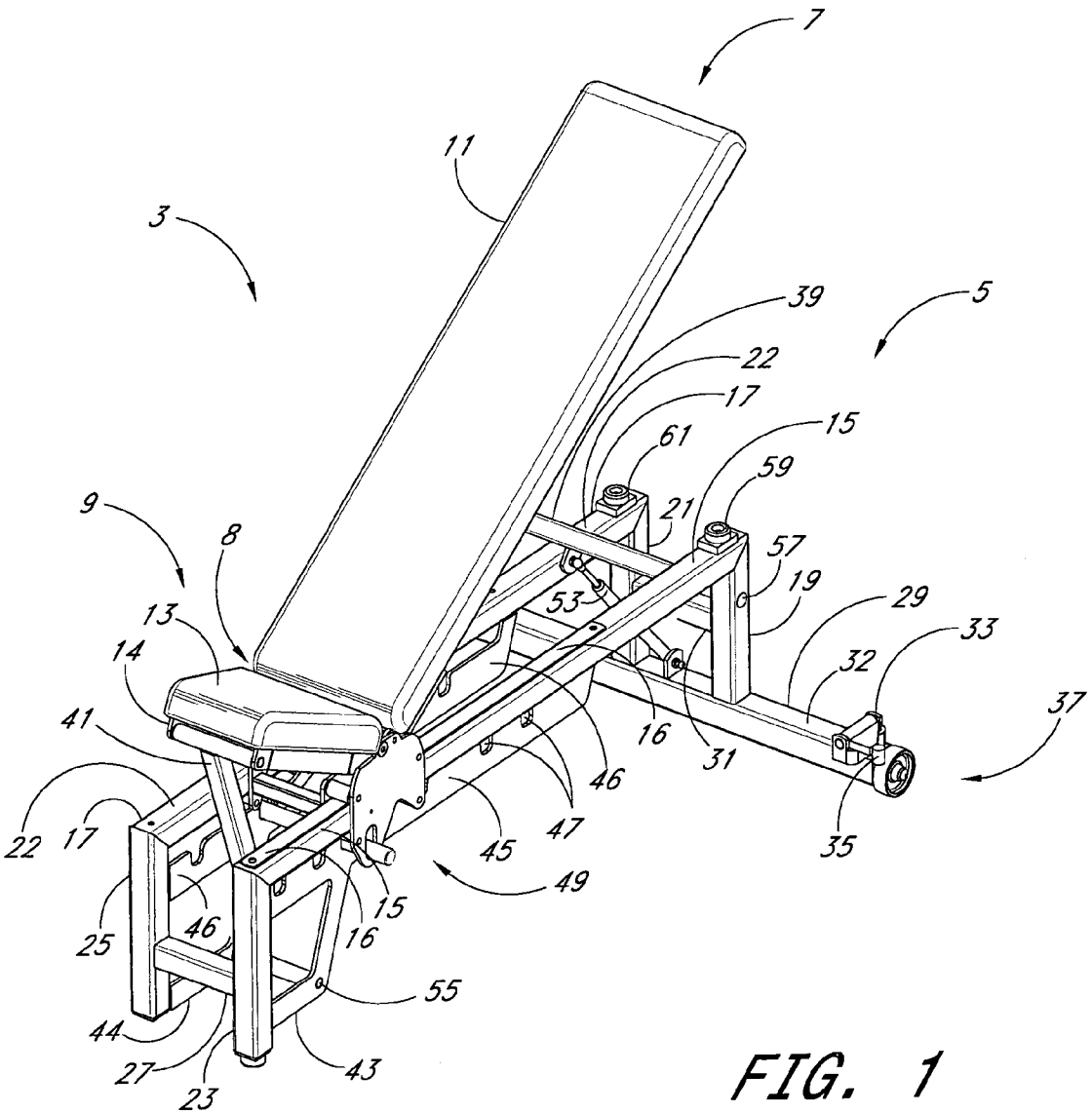
FIG. 1 is a perspective view of an adjustable bench configured in accordance with a preferred embodiment of the present invention.

Herein disclosed are methods and apparatuses relating to adjustable benches, which are particularly suitable for use in conjunction with an auxiliary rack assembly generally used for supporting a weight bar. Although certain preferred embodiments and examples are disclosed below, it will be understood by those skilled in the art that the invention extends beyond the specifically disclosed embodiments to other alternative embodiments and/or uses of the invention and obvious modifications and equivalents thereof. Thus, it is intended that the scope of the invention herein disclosed should not be limited to the embodiments described below.

FIGS. 1-5 illustrate one embodiment of an adjustable bench 3 having a frame 5. The frame 5 can be constructed of any suitable material, such as tubular steel, that can support a user during exercise. The frame 5 is comprised of a pair of substantially parallel, longitudinal frame members 15, 17, a pair of forward upright members 23, 25, a pair of rear upright members 19, 21 and a pair of transverse frame members 27, 31. The longitudinal frame members 15, 17 are respectively joined at one end with the forward upright members 23, 25 and at the other end with the rear upright members 19, 21. The forward upright members 23, 25 are interconnected by the transverse frame member 27. Likewise, the rear upright members 19, 21 are interconnected by the transverse frame member 31. Thus, from a top view, the longitudinal frame members 15, 17 and the transverse frame members 27, 31 form a generally rectangular configuration.

Figure 2:
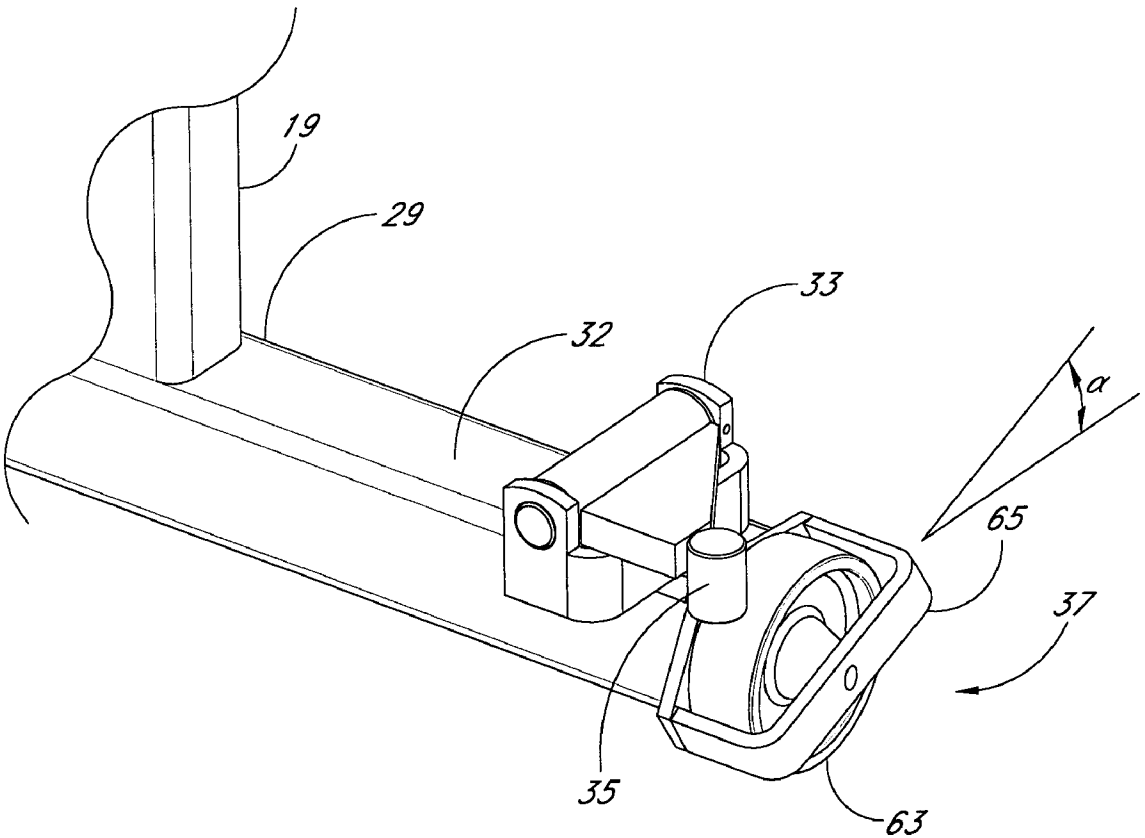
FIG. 2 is a perspective view of a portion of the adjustable bench of FIG. 1, illustrating a wheel assembly and a rotatable lock assembly.
Figure 3:
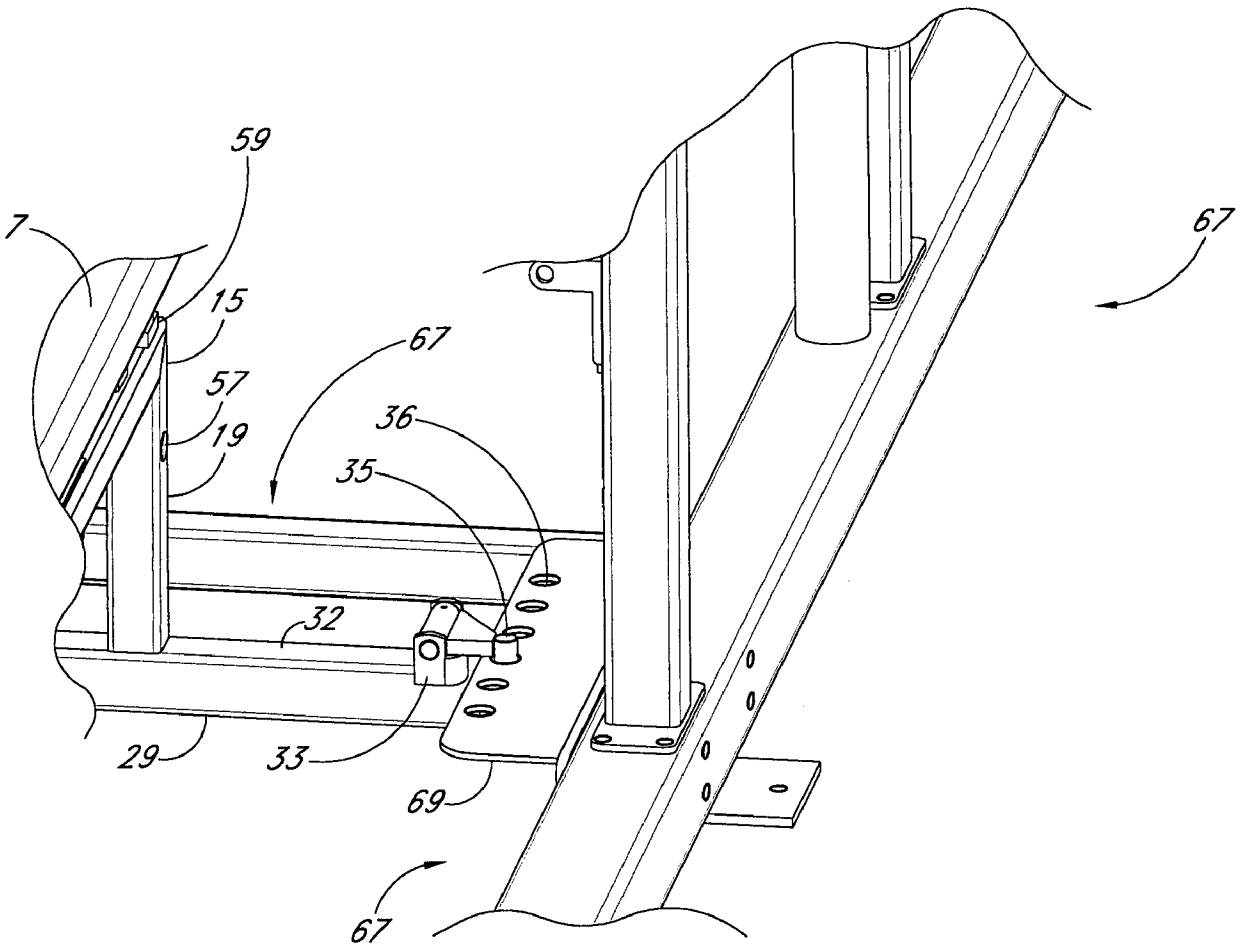
FIG. 3 is a perspective view of a portion of the adjustable bench of FIG. 1, illustrating the bench engaged with an auxiliary rack assembly.

In one embodiment, the rear frame members 19, 21 are further joined with a transverse support member 29. As best seen in FIGS. 2 and 3, a wheel assembly 37, a rotatable lock assembly 33, and a lock peg 35 are at each lateral end of the transverse support member. Each rotatable lock assembly 33 and lock peg 35 in the illustrated embodiment form a releasable interlock between the bench and the exercise equipment (an auxiliary rack assembly) at a top surface 32 of the transverse support member 29 adjacent to the wheel assembly 37; however, in other embodiments, the releasable interlock between the bench and the exercise equipment can be located at other locations on the bench. Additionally, while the releasable interlock is rotatable in the illustrated embodiment so as to be capable of being rotated into and out of engagement with structure on the exercise equipment, the releasable interlock can be fixed on the frame.

The wheel assembly 37 preferably comprises a wheel 63 and an angled bracket 65, although other means for supporting the wheel 63 may be used. The wheels 63 and the angled brackets 65 facilitate moving the adjustable bench 3. The bench 3 can be moved by generally picking up the forward end of the bench, using, for example, the forward upright members 23, 25 or an integrated handle (not shown), and pushing or pulling the bench 3 so that the wheels 63 roll along the ground, floor or other supportive surface. The angled brackets 65 are oriented at an angle $\alpha$ relative to the top surface 32 of the transverse support member 29 so that the brackets 65 do not hit or scrape the floor while the bench 3 is rolling. In one embodiment, the angle $\alpha$ is about 30 degrees. In another embodiment, the angle $\alpha$ is about 45 degrees. In other embodiments, however, the angle $\alpha$ may range between about 25 degrees and about 45 degrees. Of course, in still further embodiments, other means of facilitating bench movement may be used.

As noted above, the releasable interlock preferably couples the adjustable bench 3 with an auxiliary rack assembly 67 and releasably affix their relative positions. In the illustrated embodiment, the releasable interlock comprises the lock peg 35 and the rotatable lock assembly 33. As shown in FIG. 3, the lock peg 35 is configured to be received by a hole 36 within a lock bracket 69 that is attached to the auxiliary rack assembly 67. The hole 36 is preferably configured with sufficient clearance such that the peg 35 can be rotated into and out from this receiving engagement. In a preferred embodiment, the lock peg 35 is offset towards the forward end of the bench from the wheel assembly 37, about which the bench is lifted. Therefore, when the adjustable bench 3 is lifted for positioning relative to the rack assembly 67, the lock pegs 35 are rotated up and displaced above the lock brackets 69. The adjustable bench 3 can then be optimally positioned under the lock bracket 69, and the lock pegs 35 located above corresponding holes 36. When the adjustable bench 3 is lowered back down, the lock pegs 35 and rotatable lock assemblies 33 fall into engagement with holes 36 in the lock brackets 69, as shown in FIG. 3. The rotatable lock assemblies 33 and lock pegs 35 secure the adjustable bench 3 to the auxiliary rack assembly 67. In the illustrated embodiment, the lock bracket 69 comprises a plurality of holes 36. The holes 36 are arranged into a longitudinal row, which facilitates selection of an optimal relative position between the adjustable bench 3 and the auxiliary rack assembly 67. The auxiliary rack assembly 67 can be bolted or otherwise fastened to the floor. In this embodiment, the lock pegs 35 and rotatable lock assemblies 33, and the holes 36 in the lock bracket 69 secure the adjustable bench 3 in a locked position relative to the auxiliary rack assembly 67.

Figure 6:
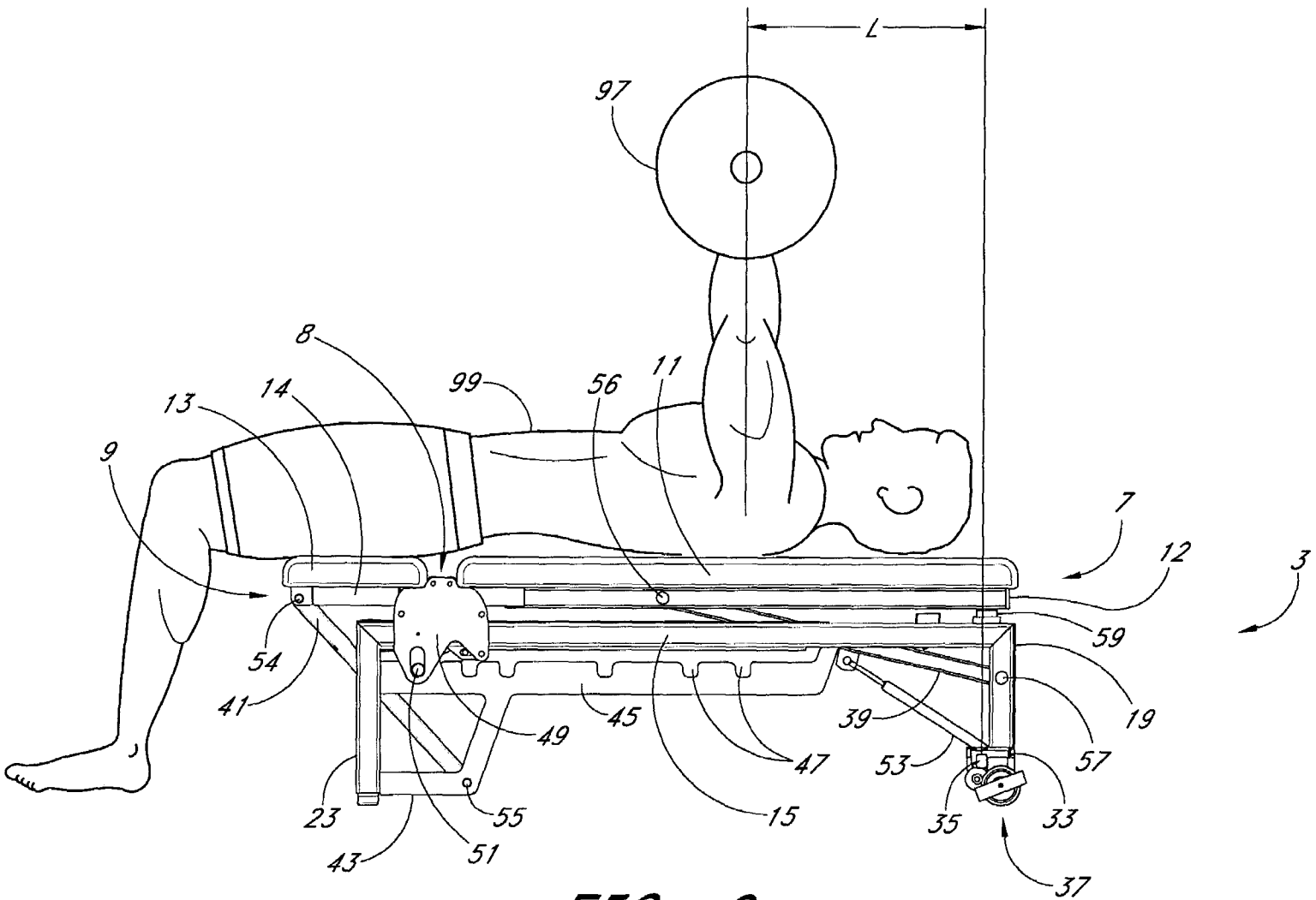
FIG. 6 is a side elevational view of the adjustable bench of FIG. 1, illustrating an exemplary use environment wherein the bench is in a flat configuration.

With reference to FIGS. 1 and 6, the adjustable bench 3 further comprises a seat 9 and a backrest 7. The seat 9 and the backrest 7 preferably each have padding 13, 11, respectively, which is configured to comfortably receive a user's 99 body (FIGS. 6-11). The seat 9 is fastened to a seat support 14. Likewise, the backrest 7 is fastened to a backrest support 12 (FIG. 6). A seat adjustment member 41 is rotatably attached at one end to the seat support 14 by a pivot 54 (FIG. 6). An opposite end of the seat adjustment member is attached via a pivot 55 to a pair of angled portions 43, 44 extending from a pair of notched braces 45, 46, respectively. The angled portions 43, 44 and the notched braces 45, 46 are secured at one end to the forward upright members 23, 25, and the notched braces 45, 46 are secured at the other end to the longitudinal frame members 15, 17, thereby fixing the pivot 55 in position, as shown in FIG. 1.

Similarly, a backrest adjustment member 39 is rotatably attached at one end to the backrest support 12 by a pivot 56 (FIG. 6). An opposite end of the backrest adjustment member 39 is attached via a pivot 57 to the pair of rear upright members 19, 21. A damper strut or stay 53 is pivotally attached to a central portion of the backrest adjustment member 39 and to the transverse frame member 31. Alternatively, the damper strut 53 can be pivotally attached to the transverse support member 29. The damper strut 53 facilitates lifting the backrest 7 upward relative to the longitudinal frame members 15, 17. The longitudinal frame members 15, 17 include a pair of rubber stops 59, 61, respectively, which cushion the backrest support 12 on the longitudinal frame members 15, 17 when the bench 3 is in a flat position, as shown in FIG. 6.

The seat 9 and backrest 7 may also be rotatably attached to one another via a traveler. The traveler moves forward and backward relative to the longitudinal frame members 15, 17 and may take a number of forms well known to those of skill in the art. In the illustrated embodiment, the traveler is a hinged bracket assembly 49 and travels horizontally along the longitudinal frame members 15, 17.

Figure 4:
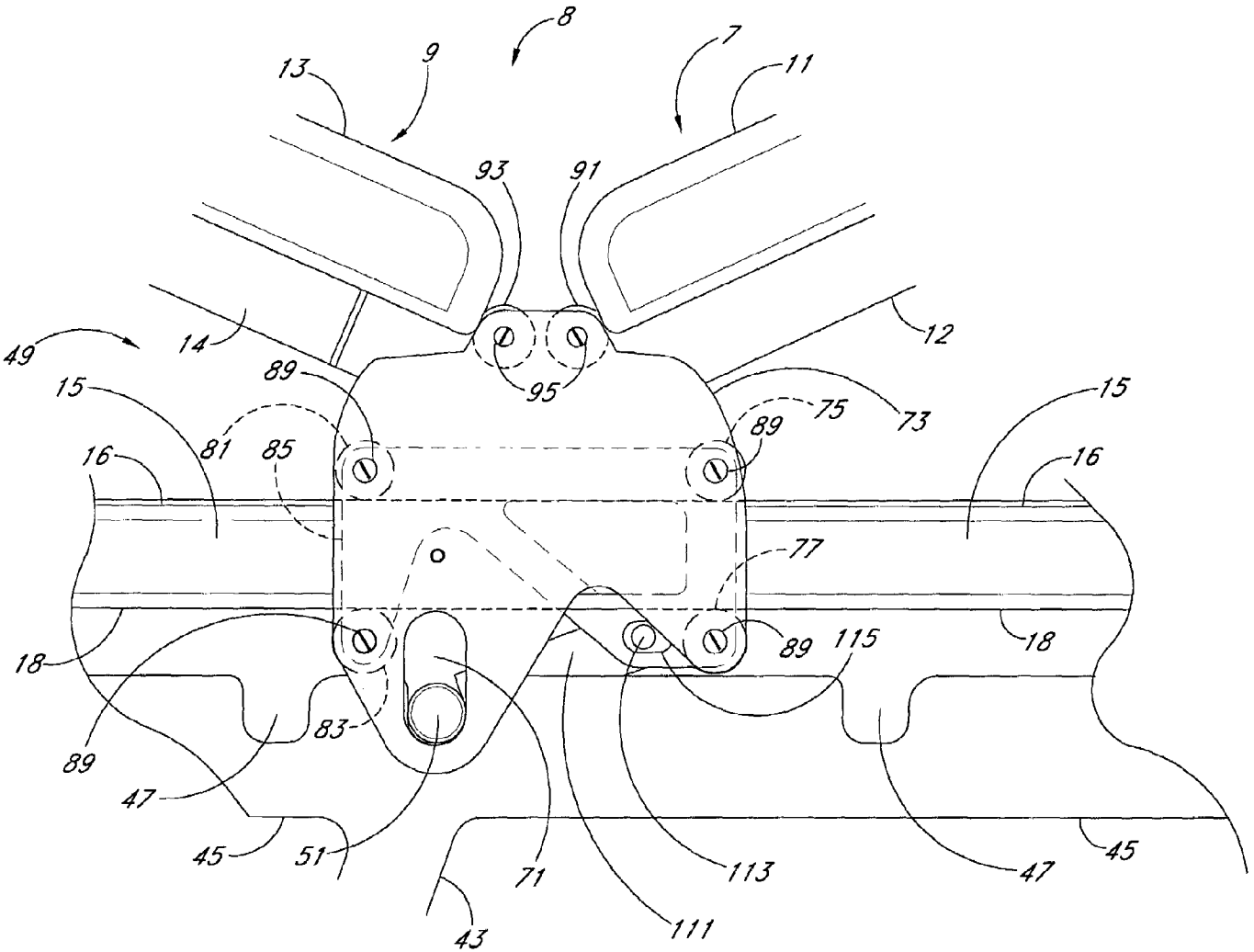
FIG. 4 is a side elevational view of a hinged bracket assembly of the adjustable bench of FIG. 1.
Figure 5:
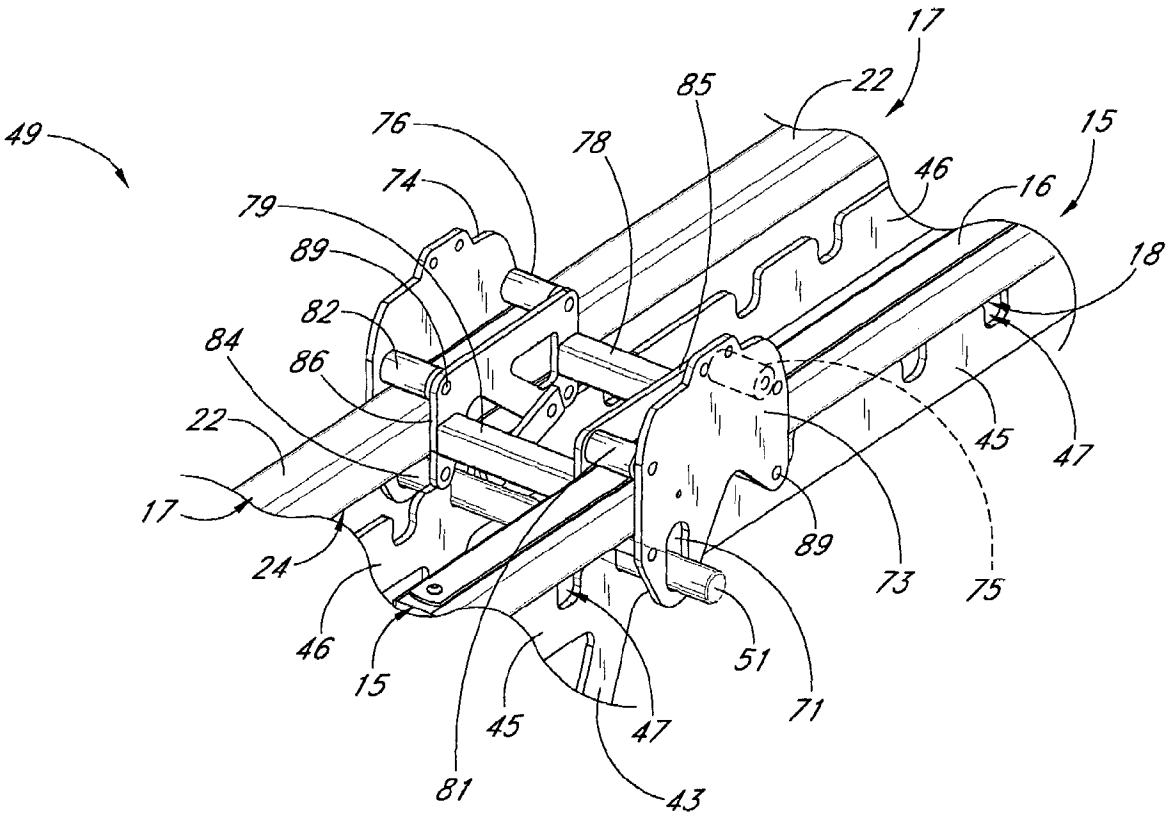
FIG. 5 is a perspective view of the hinged bracket assembly of FIG. 4.

As shown in FIGS. 4 and 5, the hinged bracket assembly 49 may comprise a pair of brackets 73, 74 positioned on opposite sides of an interface 8 between the seat 9 and the backrest 7. Each of the brackets 73, 74 has an elongated hole 71 that receives one end of an adjustment bar 51. In one form, the elongated holes 71 have a generally oval shape. In another form, the elongated holes 71 may have a generally rectangular shape. The elongated holes 71 support the adjustment bar 51 such that a middle section of the bar 51 rests within notches 47 of the notched braces 45, 46. As shown and discussed in connection with FIG. 1, the notched braces 45, 46 are secured to the longitudinal frame members 15, 17 and to the forward upright members 23, 25. Thus, the adjustment bar 51 and the notched braces 45, 46 serve as a locking assembly to hold the backrest 7 and seat 9 in fixed positions relative to the frame 5. The notches 47 are positioned in predetermined locations along the length of the notched braces 45, 46. It will be appreciated that in another embodiment, the notched brace 46 may be omitted, with the notched brace 45 being solely employed. In this embodiment, when the adjustment bar 51 rests within one of the notches 47 of the notched brace 45, the seat 9 and backrest 7 are held fixed relative to the frame 5. Of course, other forms of locking assemblies may be used to selectively fix the position of the traveler along the length of the frame.

In the illustrated embodiment, a bar support 111 may be rotatably attached via a pivot 113 at one end to each bracket 85, 86, and fixedly attached at the other end to the adjustment bar 51. As best shown in FIG. 4, the pivot 113 is supported within an elongated hole 115 on each bracket 85, 86. The bar support 111 serves to couple the adjustment bar 51 to the brackets 85, 86 so as not to slide out the sides of the bench.

When the seat 9 and the backrest 7 are set at one of a plurality of established positions along the frame 5, the adjustment bar 51 is fixed within a notch 47 under the weight of the seat 9 and backrest 7 and is further fixed within the notch 47 when the adjustable bench 3, and more specifically the seat 9, supports additional weight, such as a user's body (FIGS. 6-11). When the seat 9 supports this weight, the hinged bracket assembly 49 is pushed toward one end of the bench by the horizontal component of the weight. The sides of the elongated holes 71 in the brackets 73, 74 of the hinged bracket assembly 49 thus push the adjustment bar 51 against an edge of the notch 47, preventing further motion of the assembly 49 (as illustrated in FIG. 4). In the above manner, the adjustment bar 51 is locked so as to prevent inadvertent upward movement of the adjustment bar 51 within the elongated holes 71. When the horizontal component of the user's weight is removed from the seat 9 (such as when the user 99 is pushing backwards against the backrest 7, or when the user 99 stands up), a user can lift the adjustment bar 51. In doing so, the pivot 113 slides rearward within the elongated holes 115 as the bar support 111 and the pivot 113 rotate together.

The hinged bracket assembly 49 further comprises a plurality of wheels that facilitate moving the hinged bracket assembly 49 horizontally along the length of the longitudinal frame members 15, 17. As shown in FIGS. 4 and 5, top wheels 75, 81 are in rolling contact with a top surface 16 of the longitudinal frame member 15, and bottom wheels 77, 83 are in rolling contact with a bottom surface 18 of the longitudinal frame member 15. A plurality of fasteners 89 secures the wheels 75, 77, 81, 83 to the bracket 73 on one side of the member 15 and to a support bracket 85 on the other side of the member 15.

With continued reference to FIGS. 4 and 5, top wheels 76, 82 are in rolling contact with a top surface 22 of the longitudinal frame member 17, and bottom wheels 80, 84 are in rolling contact with a bottom surface 24 of the longitudinal frame member 17. A plurality of fasteners 89 secures the wheels 76, 80, 82, 84 to the bracket 74 on one side of the longitudinal frame member 17 and to a support bracket 86 on the other side of the member 17. A pair of transverse members 78, 79 are joined on opposite ends with the support brackets 85, 86. The transverse members 78, 79 keep the brackets 73, 74 aligned with one another and thus ensure that the adjustment bar 51 remains freely moveable within the elongated holes 71. The wheels and brackets facilitate moving the seat 9 and backrest 7 along the frame 5, but prevent the seat 9 and backrest 7 from being lifted off of the frame 5.

In the illustrated embodiment of FIGS. 4 and 5, the hinged bracket assembly 49 comprises a total of eight wheels. In another embodiment, however, the longitudinal frame member 15 may be employed without the longitudinal frame member 17. Accordingly, the hinged bracket assembly 49 need not include eight wheels, but rather can include the two top wheels 75, 81 and the two bottom wheels 77, 83. In addition, the support brackets 85, 86 and the transverse members 78, 79 can be omitted where the bracket 74 is fastened directly to the wheels 75, 77, 81, 83.

As best shown in FIG. 4, the seat 9 is rotatably attached to the hinged bracket assembly 49 via a hinge 93, which is joined with the seat support 14 and which defines a pivot axis about which the seat 9 rotates. A fastener 95 secures the hinge 93 to the brackets 73, 74. Similarly, a hinge 91, which is joined with the backrest support 12, rotatably attaches the backrest 7 to the hinged bracket assembly 49 and defines a pivot axis about which the backrest 7 rotates. A fastener 95 secures the hinge 91 to the brackets 73, 74. The hinges 91, 93 and the fasteners 95 allow for inclination of the seat 9 and backrest 7 relative to the frame 5.

Operation of the adjustable bench 3 is now disclosed as follows with reference to FIGS. 6-11. As will be apparent from a review of these figures and from the following description, a distance L between a generally vertical plane and the interface point between the bench and the exercise equipment (e.g., the auxiliary rack assembly) remains substantially constant even though the inclination of the backrest 9 is changed for different exercises. In this manner, in each inclined position of the backrest, the initial starting point of the exercise stroke (e.g., the bar position when first lifted off of the rack supports/catches), will lie substantially along the vertical plane. The user consequently does not need to reposition the bench relative to the exercise equipment as the user changes the backrest position for performing different types of exercises.

The adjustable bench 3 is shown in a generally flat configuration in FIG. 6. A user 99 lays on the bench 3, face upward, so that the user's head is generally supported on the rear portion of the backrest 7, and the user's upper back is generally supported on the middle of the backrest 7. The user 99 is shown supporting a weight bar 97 in an upright position. The weight bar 97 has a horizontal distance L from the lock pegs 35. In the flat configuration shown in FIG. 6, the adjustment bar 51 is locked in the forward-most notches 47 of the notched braces 45, 46. Those skilled in the art will recognize that the flat configuration of the bench 3 is particularly suitable for performing exercises such as, by way of example, the barbell bench press.

The user 99 may adjust the bench 3 from a variety of positions, including standing above or to the side of the adjustable bench 3. As illustrated and described below with reference to FIGS. 6-11, the user 99 preferably changes the configuration of the adjustable bench 3 while remaining generally seated on the bench 3. In this embodiment, the user 99 lifts one or both ends of the adjustment bar 51 upward within the elongated holes 71 of the brackets 73, 74 so that the bar clears the notches 47. The user 99 can then push backwards with his or her legs and move the hinged bracket assembly 49, and with it the pivot axes for the seat 9 and backrest 7, rearward on the longitudinal frame members 15, 17. In order to facilitate this movement, the user 99 also preferably applies a force directly to the backrest 7, for example, by lifting the backrest 7 as the hinged bracket assembly 49 is moved rearward. Of course, the user 99 could simply lift and pull/push the backrest 7 while standing without pushing backwards with his or her legs in order to move the hinged bracket assembly 49. Once the hinged bracket assembly 49 begins to move rearward, the user 99 releases the ends of the adjustment bar 51, allowing the bar to slide along the upper-most edges of the notched braces 45, 46. The hinged bracket assembly 49 can be moved rearward until the adjustment bar 51 drops within the elongated holes 71 and thus falls within the next available pair of notches 47. As the seat 9 moves rearward along the frame 5, the seat adjustment member 41 rotates about the pivot 55. In doing so, the upper end of the seat adjustment member 41 pivots relative to the seat support 14, thereby pushing the seat 9 into an inclined position. Similarly, as the pivot axis for the backrest 7 is moved backwards, the backrest adjustment member 39 pivots the backrest 7 into an inclined position. The adjustment bench 3 is thus placed in a first inclined configuration, as shown in FIG. 7.

Figure 7:
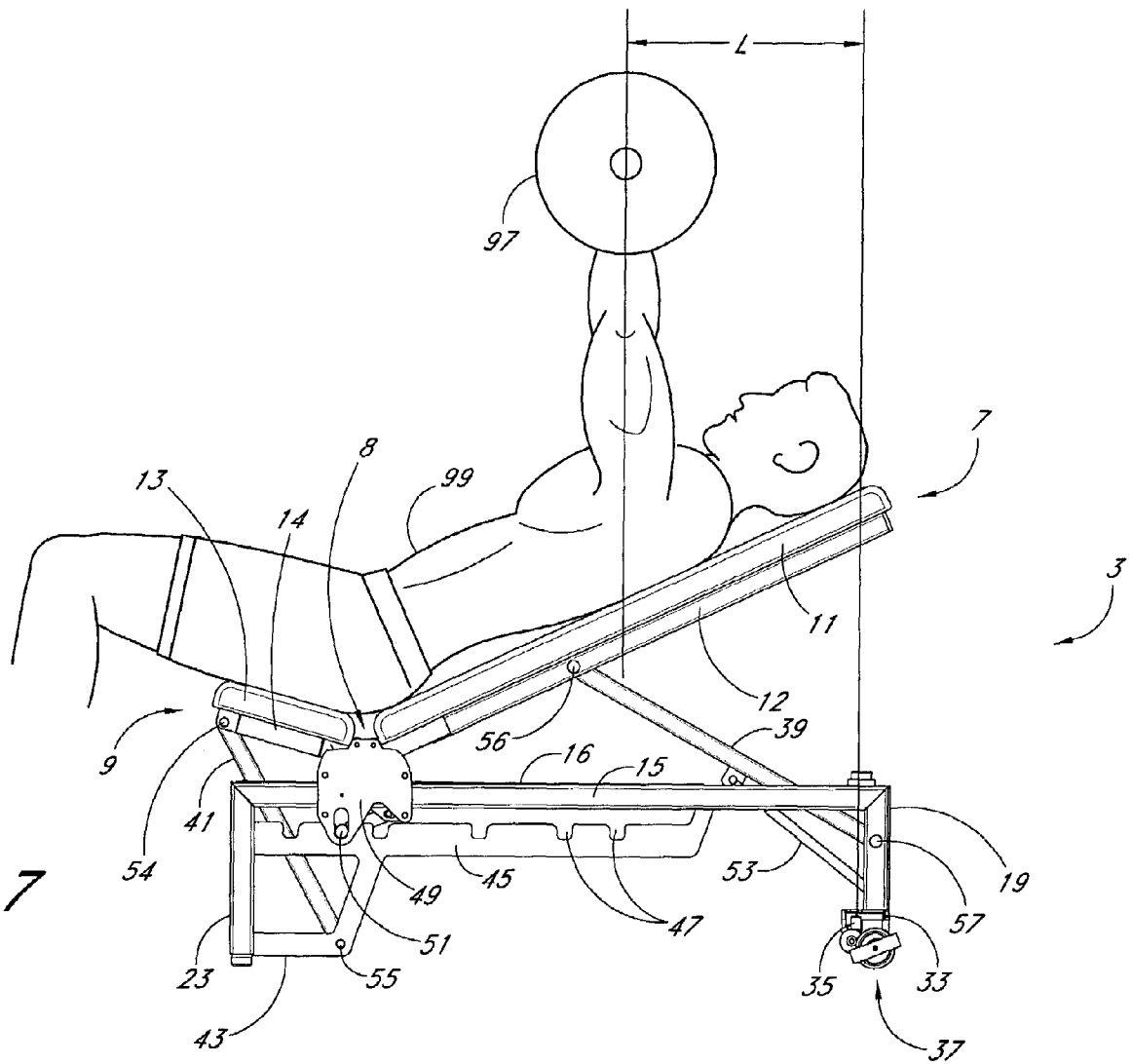
FIG. 7 is a side elevational view of the adjustable bench of FIG. 1, illustrating an exemplary use environment wherein the bench is in a first inclined configuration.

With reference to FIG. 7, the adjustable bench 3 is shown in the first inclined configuration. Accordingly, the user 99 is holding the weight bar 97 in an upright position inclined relative to the user's torso. In the inclined upright position the weight bar 97 has a horizontal distance L from the lock pegs 35. The distance L shown in FIG. 7 is substantially identical to the distance L shown and discussed in connection with FIG. 6, and therefore the position of the weight bar 97 has not changed relative to external references, such as an auxiliary rack assembly 67 attached to the lock pegs 35. This feature is particularly advantageous when the adjustable bench 3 is used in conjunction with an auxiliary rack assembly, such as the auxiliary rack assembly 67 shown in FIG. 3, which is capable of supporting the weight bar 97 over the backrest 7. The adjustable bench 3 can be changed from the generally flat configuration to the inclined configuration shown in FIG. 7 without the bench 3 having to be moved horizontally relative to the auxiliary rack assembly 67.

Figure 8:
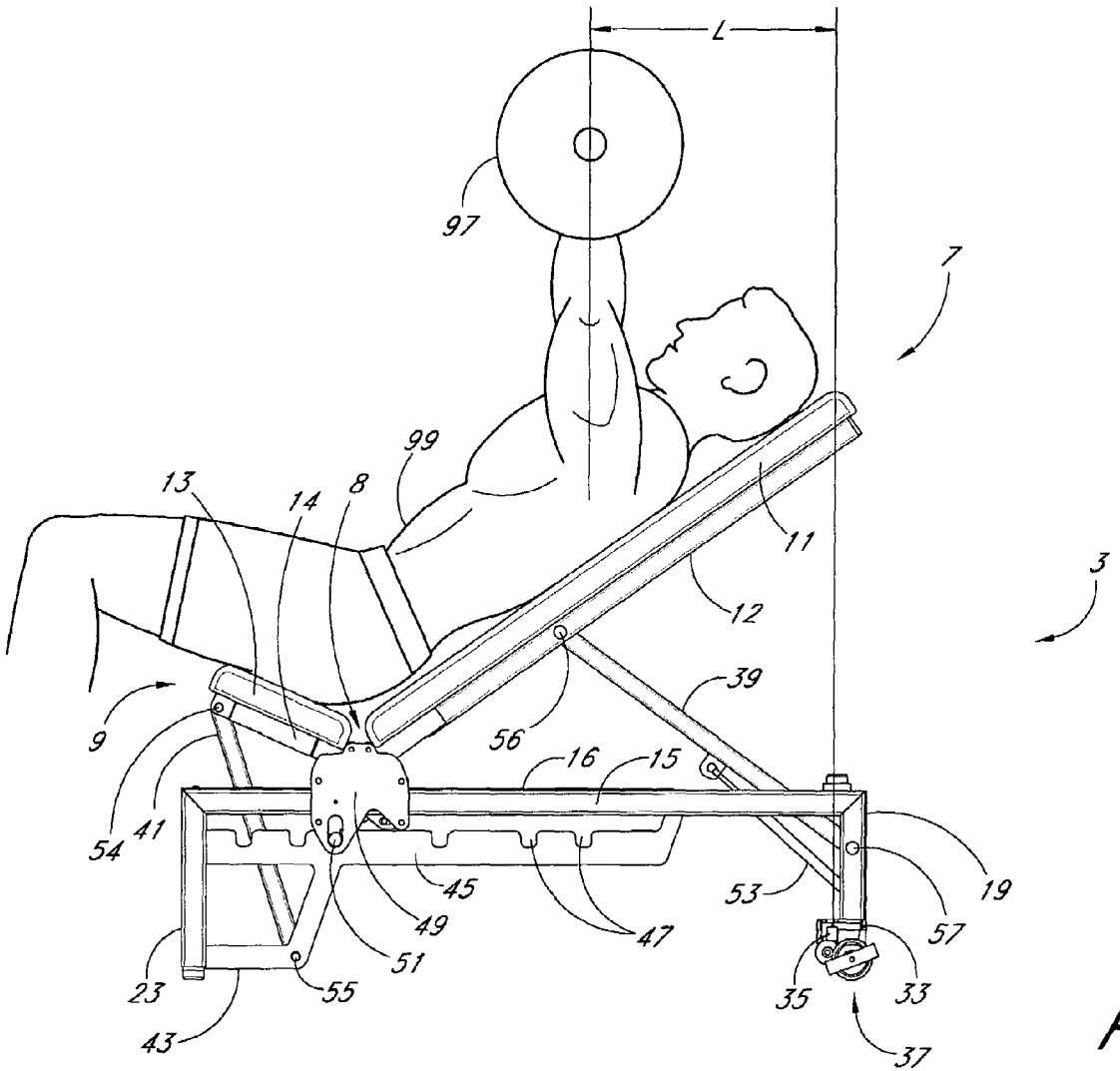
FIG. 8 is a side elevational view of the adjustable bench of FIG. 1, illustrating an exemplary use environment wherein the bench is in a second inclined configuration.

While still positioned on the bench 3, the user 99 can change the bench 3 from the first inclined configuration to a second inclined configuration shown in FIG. 8, in substantially the same way described above with respect to FIGS. 6 and 7. The user 99 lifts one or both ends of the adjustment bar 51 upward within the elongated holes 71 of the brackets 73, 74 so that the bar clears the notches 47, and pushes back with his or her legs. The hinged bracket assembly 49, and with it the pivot axes for the seat 9 and backrest 7, then moves rearward on the longitudinal frame members 15, 17. In order to facilitate this movement, the user 99 preferably applies a force directly to the seat 9 or the backrest 7, for example, by lifting the backrest 7. Once the hinged bracket assembly 49 begins to move rearward, the user 99 releases the ends of the adjustment bar 51, allowing the bar to slide along the upper-most edges of the notched braces 45, 46. The hinged bracket assembly 49 is moved rearward until the adjustment bar 51 drops within the elongated holes 71 and thus falls within the next available pair of notches 47. As the seat 9 is moved rearward along the frame 5, the seat adjustment member 41 rotates about the pivot 55. In doing so, the upper end of the seat adjustment member 41 pivots relative to the seat support 14, thereby pushing the seat 9 into a further inclined position. Similarly, as the pivot axis for the backrest 7 is moved backwards, the backrest adjustment member 39 pivots the backrest 7 into a more inclined position. The adjustment bench 3 is thus placed in the second inclined configuration, as shown in FIG. 8.

With reference to FIG. 8, the adjustable bench 3 is shown in the second inclined configuration. Accordingly, the user 99 is holding the weight bar 97 in an inclined upright position that is greater than the inclined position of the weight bar 97 shown in FIG. 7. In the inclined upright position shown in FIG. 8, the weight bar 97 has a horizontal distance L from the lock pegs 35. The distance L shown in FIG. 8 is substantially identical to the distance L shown and discussed in connection with FIGS. 6 and 7, and therefore the position of the weight bar 97 has not changed relative to external references, such as an auxiliary rack assembly 67 attached to the lock pegs 35. As the adjustable bench 3 is changed from the flat configuration shown in FIG. 6 to the first inclined configuration shown in FIG. 7 and then to the second inclined configuration shown in FIG. 8, the shoulders of the user 99 travel generally along a vertical plane. As discussed above, this feature is particularly suitable when the adjustable bench 3 is used with the auxiliary rack assembly 67, wherein the rack assembly supports the weight bar 97 over the backrest 7. The adjustable bench 3 can be changed from the flat configuration to the first and second inclined configurations without the bench 3 having to be moved horizontally relative to the auxiliary rack assembly 67.

Figure 9:
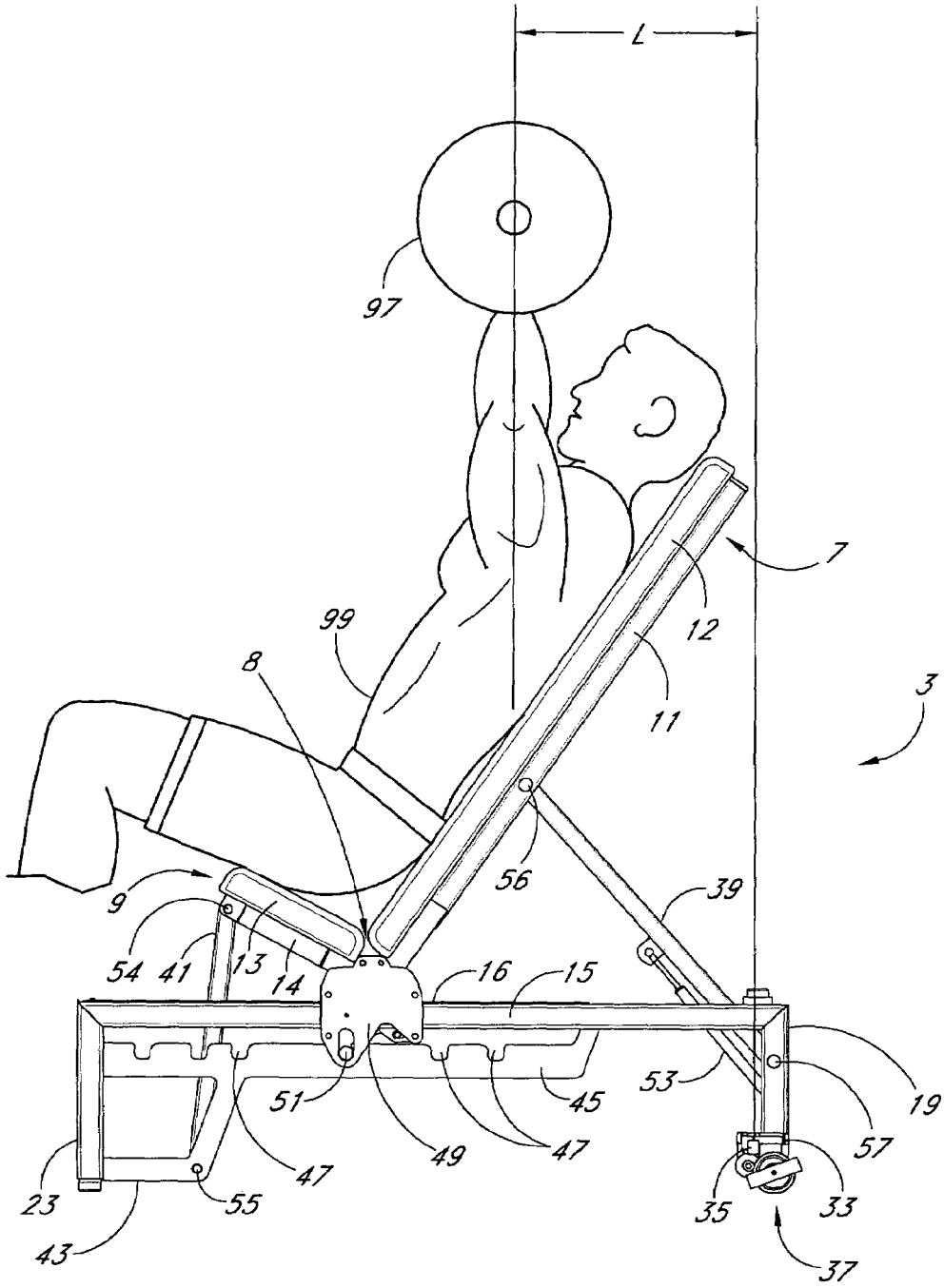
FIG. 9 is a side elevational view of the adjustable bench of FIG. 1, illustrating an exemplary use environment wherein the bench is in a third inclined configuration.

With reference to FIG. 9, the procedure for changing the adjustable bench 3 from the second inclined configuration to the third inclined configuration is substantially the same as the procedure outlined above with reference to FIGS. 6-8. While positioned on the adjustable bench 3, as shown in FIG. 8, the user 99 lifts the adjustment bar 51 to an upward position within the elongated holes 71 of the brackets 73, 74 and pushes backward with his or her legs. The upward position of the adjustment bar 51 within the holes 71 allows the bar to clear the notches 47. The user 99 thus moves the hinged bracket assembly 49, and with it the pivot axes for the seat 9 and backrest 7, rearward along the longitudinal frame members 15, 17, and allows the ends of the adjustment bar 51 to slide along the upper-most edges of the notched braces 45, 46. In order to facilitate this movement, the user 99 preferably applies a force directly to the backrest 7, for example, by lifting the backrest 7. As the seat 9 moves rearward along the frame 5, the seat adjustment member 41 rotates about the pivot 55. In doing so, the upper end of the seat adjustment member 41 pivots relative to the seat support 14, thereby pushing the seat 9 into a more inclined position. Similarly, as the pivot axis for the backrest 7 is moved backwards, the backrest adjustment member 39 pivots the backrest 7 into a more inclined position. The hinged bracket assembly 49 locks the seat 7 and backrest 9 in the third inclined configuration when the adjustment bar 51 drops into the pair of notches 47 defining the third inclined configuration.

In FIG. 9, the user 99 is shown holding the weight bar 97 in an upright position that is more inclined relative to the user's torso than the positions shown in FIGS. 7 and 8. In the upright position shown in FIG. 9, the weight bar 97 has a horizontal distance L from the lock pegs 35. The distance L shown in FIG. 9 is substantially identical to the distance L shown and discussed in connection with FIGS. 6-8, and therefore the position of the weight bar 97 has not changed relative to external references. As discussed above, because the shoulders of the user 99 remain positioned generally over the same location, the user need not shift the bench 3 horizontally relative to the auxiliary rack 67.

The procedure for changing the adjustable bench 3 from the third inclined configuration (FIG. 9) to the fourth inclined configuration (FIG. 10) is substantially identical in all respects to the procedures outlined above with reference to FIGS. 6-9. While positioned on the adjustable bench 3, the user 99 lifts the adjustment bar 51 to an upward position within the elongated holes 71 of the brackets 73, 74, thereby allowing the bar to move out of the notches 47. The user 99 then pushes backward with his or her body, moving the hinged bracket assembly 49, and with it the pivot axes for the seat 9 and backrest 7, rearward along the longitudinal frame members 15, 17, allowing the adjustment bar 51 to slide along the upper-most edges of the notched braces 45, 46. As the seat 9 moves rearward along the frame 5, the seat adjustment member 41 rotates about the pivot 55. In doing so, the upper end of the seat adjustment member 41 pivots relative to the seat support 14, thereby pushing the seat 9 into a less inclined position. Similarly, as the pivot axis for the backrest 7 is moved backwards, the backrest adjustment member 39 pivots the backrest 7 into a more inclined position. The hinged bracket assembly 49 locks the seat 7 and backrest 9 in the fourth inclined configuration when the adjustment bar 51 drops into the next available pair of notches 47.

Figure 10:
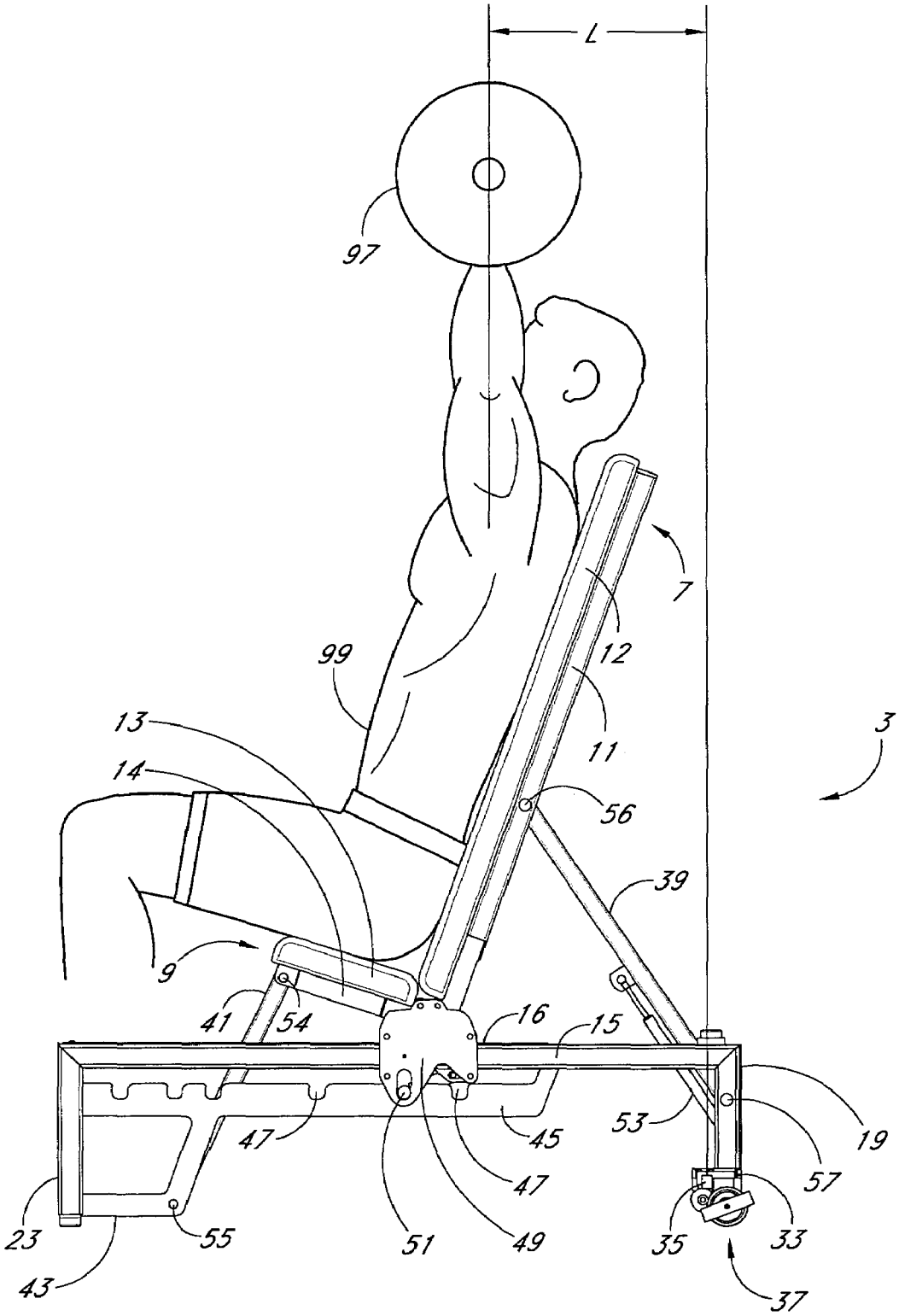
FIG. 10 is a side elevational view of the adjustable bench of FIG. 1, illustrating an exemplary use environment wherein the bench is in a fourth inclined configuration.

In FIG. 10, the user 99 is shown holding the weight bar 97 in an upright position that is more inclined relative to the user's torso than the upright positions shown in FIGS. 7-9. In the upright position shown in FIG. 10, the weight bar 97 has a horizontal distance L from the lock pegs 35. The distance L shown in FIG. 10 is substantially identical in all respects to the distance L shown and discussed in connection with FIGS. 6-9, and therefore the position of the weight bar 97 has not changed relative to external references. Because the shoulders of the user 99 remain positioned generally over the same location, the user 99 need not shift the bench 3 horizontally relative to the auxiliary rack 67.

The procedure for changing the adjustable bench 3 from the fourth inclined configuration (FIG. 10) to the fifth inclined configuration (FIG. 11) is substantially identical in all respects to the procedures outlined above with reference to FIGS. 6-10. While positioned on the adjustable bench 3, the user 99 lifts the adjustment bar 51 upward within the elongated holes 71 of the brackets 73, 74, thereby allowing the bar to move out of the notches 47. The user 99 pushes backward to move the hinged bracket assembly 49, and with it the pivot axes for the seat 9 and backrest 7, rearward along the longitudinal frame members 15, 17 until the adjustment bar 51 drops into the next available pair of notches 47, defining the fifth inclined configuration. As the seat 9 moves rearward along the frame 5, the seat adjustment member 41 rotates about the pivot 55. In doing so, the upper end of the seat adjustment member 41 pivots relative to the seat support 14, placing the seat in a nearly horizontal configuration. Similarly, as the pivot axis for the backrest 7 is moved backwards, the backrest adjustment member 39 pivots the backrest 7 into a nearly vertical position.

Figure 11:
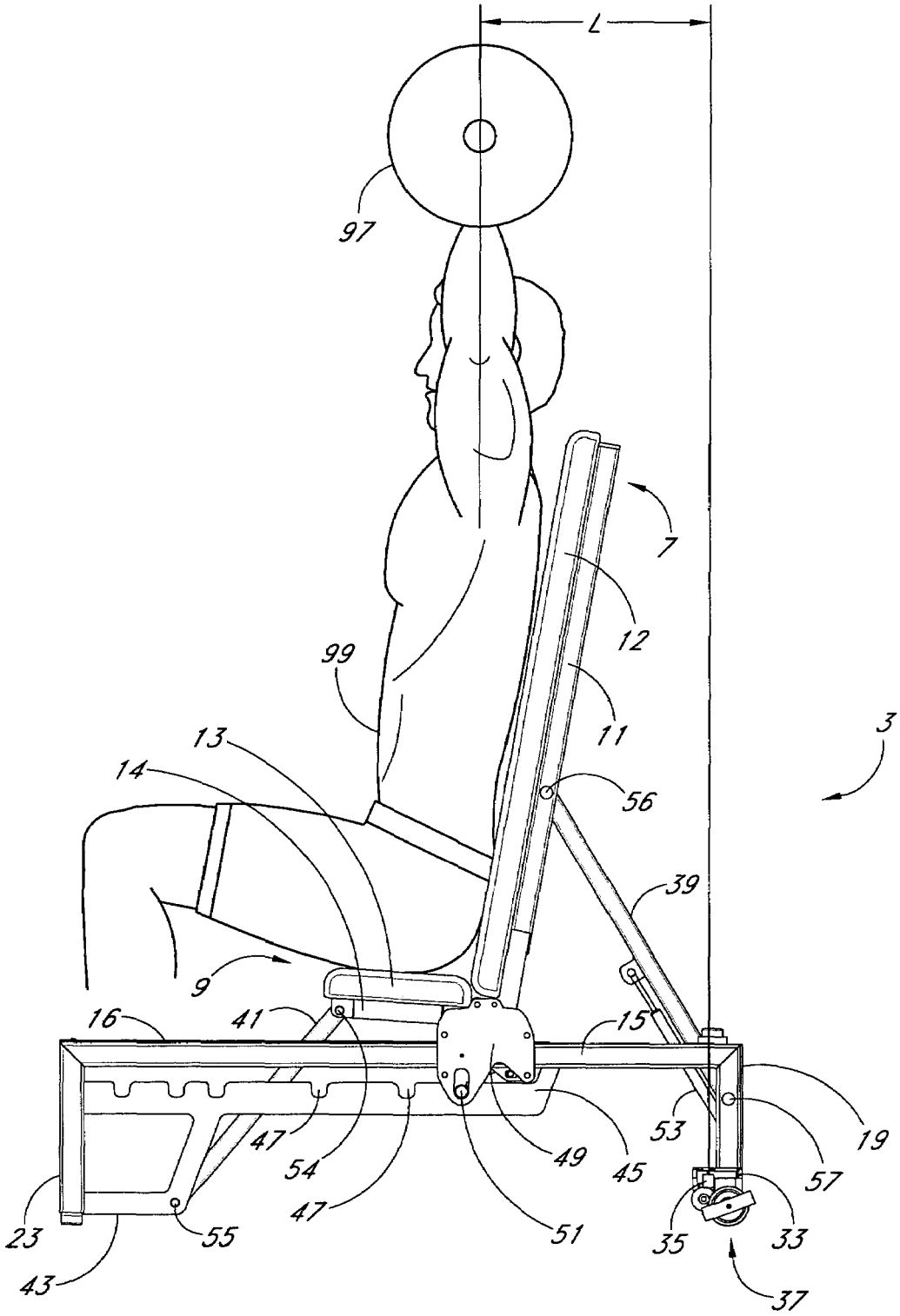
FIG. 11 is a side elevational view of the adjustable bench of FIG. 1, illustrating an exemplary use environment wherein the bench is in a fifth inclined configuration.

With reference to FIG. 11, the user 99 is shown holding the weight bar 97 in an upright position relative to the user's torso that is greater than the upright positions shown in FIGS. 3-10. In the upright position shown in FIG. 11, the weight bar 97 has a horizontal distance L from the lock pegs 35. The distance L shown in FIG. 11 is substantially identical in all respects to the distance L shown and discussed in connection with FIGS. 6-10, and therefore the position of the weight bar 97 has not changed relative to external references. Because the distance L remains unchanged as the bench 3 is inclined, the user's 99 shoulders remain positioned generally over the same location. This obviates the need for the user 99 to shift the bench 3 horizontally relative to the auxiliary rack 67 to position the shoulders optimally under the weight bar 97.

It will be appreciated that the adjustable bench 3 is not limited solely to sequential configuration changes. Rather, the adjustable bench 3 can be changed from any one angle of inclination to any other of the above-discussed angles of inclination. For example, the user 99 may wish to change the bench 3 from the flat configuration shown in FIG. 6 directly to the fifth inclined configuration shown in FIG. 11. While lying on the bench 3 as shown in FIG. 6, the user 99 lifts one or both ends of the adjustment bar 51 to an upward position within the elongated holes 71 of the brackets 73, 74 so that the bar moves out of the notches 47. The user 99 then moves the hinged bracket assembly 49 rearward along the longitudinal frame members 15, 17. While the hinged bracket assembly 49 moves, the user 99 holds the adjustment bar 51 in the upward position within the elongated holes 71. This allows the adjustment bar 51 to pass over the notches 47 defining other angles of inclination. Once the adjustment bar 51 passes rearward of the notches 47 defining the fourth inclined configuration, the user 99 releases the adjustment bar 51. The adjustment bar 51 then slides along the uppermost edges of the notched braces 45, 46 until falling within the pair of notches 47 defining the fifth inclined configuration, as shown in FIG. 11. Of course, other numbers and configurations may be implemented, as is well-known to those of skill in the art.

Although preferred embodiments and methods have been described in detail, certain variations and modifications thereof will be apparent to those skilled in the art, including embodiments and/or methods that do not provide all of the features and benefits described herein. Accordingly, the scope of the above-discussed embodiments and methods is not to be limited by the illustrations or the foregoing descriptions thereof, but rather solely by the claims.

What is claimed is:

1. An exercise bench for resistance training, such as weight lifting, comprising:

a frame;

a seat mounted on said frame;

a backrest mounted on said frame;

a traveler mounted to move generally linearly along said frame and pivotally connected to said seat and said backrest such that said seat and said backrest simultaneously pivot relative to said frame due at least in part to said traveler moving generally linearly along said frame.

2. The bench of claim 1 additionally comprising an elongate member pivotally attached to said frame at a first location, and pivotally attached to said backrest at a second location, wherein said first pivot location remains fixed in response to raising or lowering said backrest, while said second pivot location moves both vertically and horizontally in response to said raising or lowering.

3. The bench of claim 2, wherein said traveler is attached to said backrest substantially at a pivot axis of said backrest, and further comprising a locking assembly for detachably fastening said traveler to said frame at a plurality of horizontally spaced locations along the frame.

4. The bench of claim 3, wherein said seat pivots about a second pivot axis.

5. The bench of claim 4, comprising a second elongate member pivotally attached to said frame at a third location, and pivotally attached to the seat at a fourth location, wherein said third pivot location remains fixed in response to raising or lowering said backrest, while said fourth pivot location moves both vertically and horizontally in response to said raising or lowering.

6. The bench of claim 3, wherein said locking assembly comprises a bar, and said traveler comprises a generally vertically oriented elongate hole in which said bar resides, said frame including a plurality of notches at said spaced locations, said notches being at a height corresponding to a lower portion of the elongate hole such that the bar may be engaged or disengaged from the frame by lowering or raising the bar, respectively, within the elongate hole.

7. The bench of claim 1, comprising a wheel assembly at one end of the frame to facilitate moving the bench.

8. The bench of claim 1, comprising a releasable interlock mechanism for securing the bench to an auxiliary rack assembly.

9. The bench of claim 8, wherein said releasable interlock mechanism comprises a lock peg.

10. An exercise bench, comprising:

a backrest and a seat, each having an adjustable angle of inclination about respective pivot axes, said seat mounted on a frame such that adjustment of said angle of inclination for said backrest causes each of said seat and said backrest to simultaneously rotate about said respective pivot axes in opposite directions and causes translation of the pivot axes generally horizontally as said angle is adjusted, wherein said translation causes a location of shoulder height on the backrest to move along a generally vertical axis as said angle of inclination changes.

11. An exercise bench, comprising:

a backrest and a seat, each having an adjustable angle of inclination around respective pivot axes; and means for moving a location of shoulder height on said backrest along a generally vertical axis as said angle of inclination is changed such that when said location of shoulder height is moved the seat and the backrest simultaneously rotate in opposite directions and said pivot axes both simultaneously translate generally linearly.

12. A method of adjusting an exercise bench, comprising:

exercising with a backrest and a seat of the bench in a first position that is significantly less inclined relative to a second position, said backrest and said seat being pivotally connected to a traveler; and moving said traveler generally horizontally to at least in part to cause said backrest and said seat to simultaneously rotate in opposite directions to the second position without moving the bench such that, when exercising with the backrest and the seat in the second position, the shoulders of the user are in substantially the same vertical plane as when exercising with the backrest and the seat in the first position.

13. The method of claim 12, wherein said backrest is moved from the first position to the second position at least in part by pushing backwards with the user's legs while sitting on a seat of the bench.

14. The method of claim 13, wherein said backrest is moved from the first position to the second position at least in part by lifting the backrest.

15. The method of claim 12, wherein said backrest is moved from the first position to the second position at least in part by lifting the backrest.

16. The method of claim 12 additionally comprising locking the backrest in one of said positions by manipulating a locking member that engages a frame and prevents said backrest from moving generally horizontally relative to said frame.

17. An exercise bench for resistance training, such as weight lifting, comprising:

a frame;

a seat mounted on said frame; and a backrest mounted with the seat on the frame such that said seat pivots relative to said frame in a first direction about a pivot axis as said backrest is rotated in a second direction to a plurality of positions between generally upright and generally prone, the second direction being opposite to the first direction, wherein said pivot axis moves generally linearly along said frame due at least in part to raising or lowering said backrest.

18. The bench of claim 17, further comprising an elongate member pivotally attached to said frame at a first location, and pivotally attached to the seat at a second location, wherein said first pivot location remains fixed in response to raising or lowering said backrest, while said second pivot location moves both vertically and horizontally in response to said raising or lowering such that a range of horizontal motion for said second pivot location extends both rearward and forward of said first pivot location.

19. A method of adjusting an exercise bench, comprising:

exercising with a backrest and a seat of the bench in a first position that is significantly less inclined relative to a second position, said backrest and said seat being pivotally connected to a traveler; and moving said traveler generally horizontally to at least in part to cause said backrest and said seat to simultaneously adjust to the second position without moving the bench such that, when exercising with the backrest and the seat in the second position, the shoulders of the user are in substantially the same vertical plane as when exercising with the backrest and the seat in the first position, wherein said backrest is moved from the first position to the second position at least in part by pushing backwards with the user's legs while sitting on a seat of the bench.

20. A method of adjusting an exercise bench, comprising:

exercising with a backrest and a seat of the bench in a first position that is significantly less inclined relative to a second position, said backrest and said seat being pivotally connected to a traveler; and moving said traveler generally horizontally to at least in part to cause said backrest and said scat to simultaneously adjust to the second position without moving the bench such that, when exercising with the backrest and the seat in the second position, the shoulders of the user are in substantially the same vertical plane as when exercising with the backrest and the seat in the first position, wherein said backrest is moved from the first position to the second position at least in part by lifting the backrest.

21. A method of adjusting an exercise bench, comprising:

exercising with a backrest and a seat of the bench in a first position that is significantly less inclined relative to a second position, said backrest and said seat being pivotally connected to a traveler;

moving said traveler generally horizontally to at least in part to cause said backrest and said seat to simultaneously adjust to the second position without moving the bench such that, when exercising with the backrest and the seat in the second position, the shoulders of the user are in substantially the same vertical plane as when exercising with the backrest and the seat in the first position; and locking the backrest in one of said positions by manipulating a locking member that engages a frame and prevents said backrest from moving generally horizontally relative to said frame.

22. An exercise bench for resistance training, such as weight lifting, comprising:

a frame;

a seat mounted on said frame;

a backrest mounted with the seat on the frame such that said seat pivots relative to said frame about a pivot axis as said backrest is moved to a plurality of positions between generally upright and generally prone, wherein said pivot axis moves generally linearly along said frame due at least in part to raising or lowering said backrest; and an elongate member pivotally attached to said frame at a first location, and pivotally attached to the seat at a second location, wherein said first pivot location remains fixed in response to raising or lowering said backrest, while said second pivot location moves both vertically and horizontally in response to said raising or lowering such that a range of horizontal motion for said second pivot location extends both rearward and forward of said first pivot location.

* * * * *